United States Patent [19]

Sawaoka

[11] 4,136,941

[45] Jan. 30, 1979

[54] ELECTROPHOTOGRAPHIC COPYING MACHINE

[75] Inventor: Eiji Sawaoka, Zama, Japan

[73] Assignee: Tokyo Shibaura Electric Co., Ltd., Kawasaki, Japan

[21] Appl. No.: 759,553

[22] Filed: Jan. 14, 1977

[51] Int. Cl.[2] ..... G03G 15/00

[52] U.S. Cl. ..... 355/3 R; 355/8

[58] Field of Search ..... 355/3 R, 11, 8, 50, 355/51, 66; 271/77

[56] References Cited

U.S. PATENT DOCUMENTS

| | | | |
|---|---|---|---|
| Re. 28,828 | 5/1976 | Komori et al. | 355/8 |
| 3,239,215 | 3/1966 | Davis et al. | 271/277 |
| 3,438,706 | 4/1969 | Tanaka et al. | 355/8 X |
| 3,704,944 | 12/1972 | Komori et al. | 355/66 X |
| 4,017,173 | 4/1977 | Komori et al. | 355/8 |

*Primary Examiner*—R. L. Moses

*Attorney, Agent, or Firm*—Cushman, Darby & Cushman

[57] ABSTRACT

An electrophotographic copying machine comprises a photoconductive drum rotatably disposed in the electrophotographic copying machine body, an original holder movable beyond one of the sides of the electrophotographic copying machine, a receptacle for receiving the copied paper and provided at the same side beyond which the original holder moves, a copy paper cassette provided at the same side as that at which the receptacle is provided, and a mechanism for transporting the copy paper from the copy paper cassette to the receptacle.

7 Claims, 3 Drawing Figures

ELECTROPHOTOGRAPHIC COPYING MACHINE

BACKGROUND OF THE INVENTION

The present invention relates to a copying machine and, more particularly, to an electrophotographic copying machine of the type in which the original holder is reciprocated in photocopying operation.

In general, an electrophotographic copying machine of such a type is provided at both sides of the machine body with a copy paper supplying cassette and a receptacle for receiving the copied paper, respectively and on the top wall with an original holder movable beyond one side or both sides of the electrophotographic copying machine in photocopying operation. Recently owing to the machine body small in size and light in weight, the photocopying machine has been relatively prevailingly used, but for practical use, the electrophotographic copying machine requires about two times of the area occupied by the machine per se and is a nuisance in the machine operation.

SUMMARY OF THE INVENTION

Accordingly, a primary object of the present invention is to provide an electrophotographic copying machine which requires a relatively small area necessary for the practical use of the machine and which is operable in an easy manner.

According to the present invention, the just-mentioned object is achieved by an electrophotographic copying machine comprising a machine body including first and second sides to be opposited to each other, means for forming an image on a copy paper, an original holder reciprocated on the body to extend over the first side, copy paper supplying means provided on the first side, a receptacle for receiving the copied paper and provided on the first side, and a mechanism for transporting the copy paper from the copy paper supplying means to the receptacle.

As described above, the receptacle and the copy paper supplying cassette are provided at the same side as that of the electrophotographic copying machine beyond which the original holder moves. Therefore, the area necessary for practical use of the electrophotographic copying machine is small as compared with the conventional one provided at both sides with the receptacle and the paper cassette holder, respectively. Additionally, the machine operation is easy, with the same reason.

Other objects and features of the present invention will be apparent from the following description taken in connection with the accompanying drawings, in which:

DESCRIPTION OF THE PREFERRED EMBODIMENT

Figure 1:
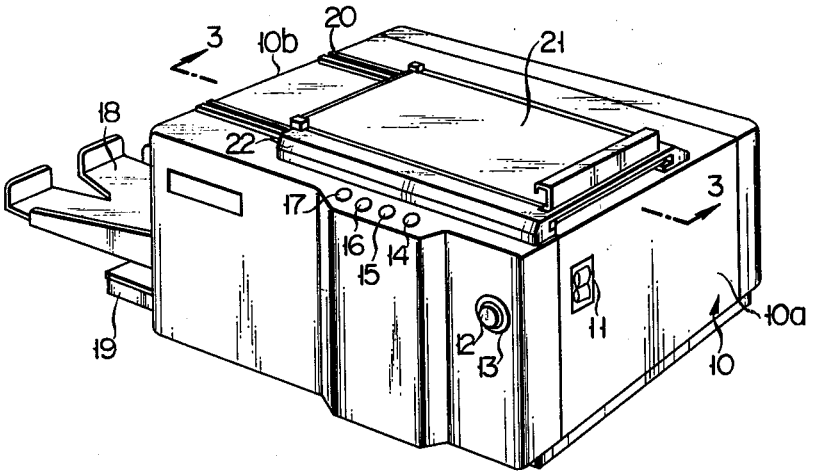
FIG. 1 is a perspective view of an outer appearance of an electrophotographic copying machine of the present invention which is an embodiment.

An embodiment of an electrophotographic copying machine according to the present invention will now be described by way of example and with reference to the accompanying drawings. Corresponding parts in the different drawings have been given the same reference numerals. Some words indicating direction, relative position and the like are used only in connection with the view of the drawings for clearity and brevity.

Referring now to FIG. 1, there is shown an outer appearance of an electrophotographic copying machine body 10 according to the present invention. The machine body 10 includes a right wall 10*a*, a left wall 10*b*, and the other sides. A power switch 11 is provided this side at the right wall 10*a*. A print button 12 and a multicopy selector dial 13 are provided on the right-hand side of the front wall of the body 10. A power lamp 14, a ready lamp 15, a check lamp 16, and an empty lamp 17 are provided on the top wall of the body 10.

A receptacle 18 for receiving the sheets of copied paper is attached onto the left wall 10*b* of the machine body 10 and a paper supplying cassette 19 is seen under the receptacle 18 on the same wall. p Moreover as described british Pat. No. 1259745, a pair of rails 20 are laid on the top wall of the machine body 10. An original holder 22 with a holder cover 21 and held original A is slidable along the rail 20. More precisely, in photocopying operation, the original holder 22 slides from the home position as shown in the figure (FIG. 1) to the left beyond the machine body 10 and then returns to the home position.

Figure 2:
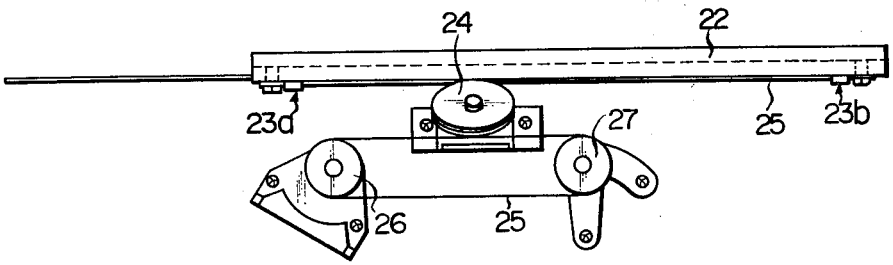
FIG. 2 is schematically view of the reciprocal movement mechanism of an original holder.

FIG. 2 shows the mechanism permitting the holder cover 21 to effect such a reciprocating motion. A wire 25 wrapped around a slant pulley 24 is fixed at the respective ends to wire grips 23*a*, 23*b* formed at both ends of the original holder 22. A drive pulley 26 and a tension pulley 27 are arranged at the right and left sides of thd slant pulley 24. Those pulleys 26 and 27 are coupled with the wire 25 wrapping around the slant pulley 24. With such a construction, one drive pulley 26 rotates in clockwise and anticlockwise directions alternately, resulting in the reciprocating motion of the original holder 22.

Figure 3:
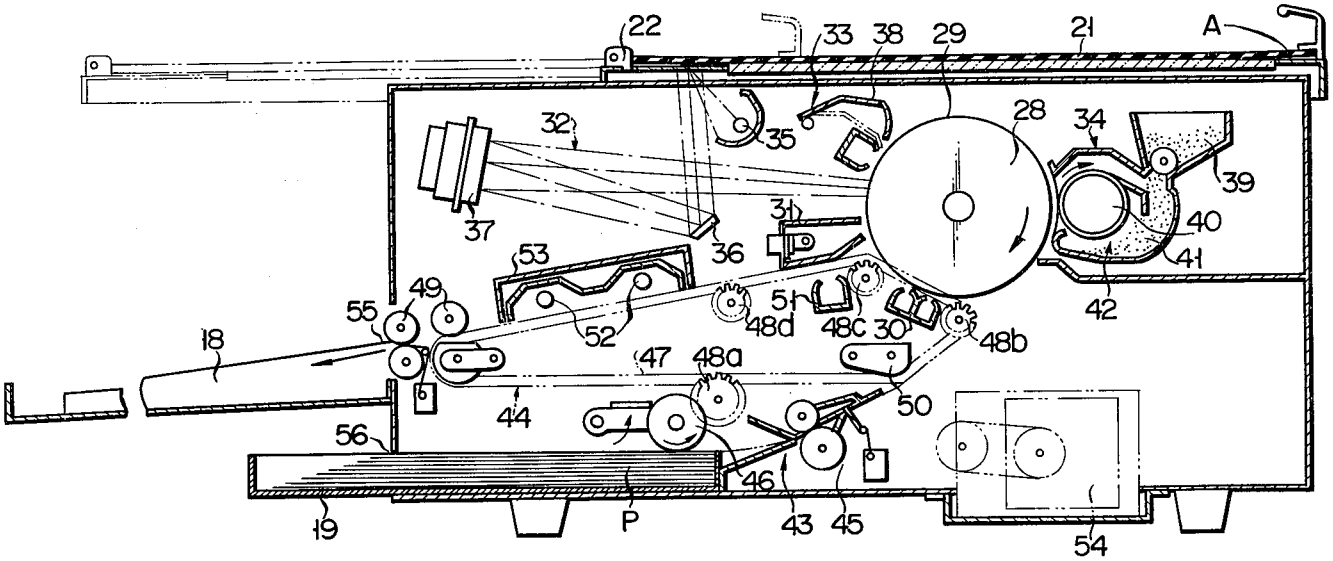
FIG. 3 is a cross-sectional view taken along the section line 3—3 of FIG. 1.

Reference is now made to FIG. 3. A photosensitive rotary drum 28 is disposed at substantially the center but slightly upwardly deviated position in the machine body 10. The photosensitive rotary drum 28 rotates clockwise, i.e. in the direction as indicated by an arrow, at a peripheral speed equal to the transfer speed of the original holder 22. The outer surface of the rotary drum 28 is provided with photosensitive surface 29. Along the photosensitive surface 29 is provided a charging-transfer means 30, a residual image eraser 31, an exposure means 32 or an optical system, a corona charge remover 33 and a development-cleaning means 34. Two times of revolutions of the rotary drum 28 completes one cycle of the electrophotographic operation. The charging-transfer means 30 scatters negative charges over the photosensitive surface 29 of the rotary drum 28. The exposure means 32 disposed at the left upper side in the machine body 10 is comprised of a lamp 35, a mirror 36 and a mirror lens 37 and acts to form an electrostatic latent image inversed on the photosensitive surface 29 of the rotary drum 28. The corona charge remover 33 is provided with a corona shielding means 38. The development-cleaning means 34 includes a toner supply means 39 and a magnetic brush 42 comprising a magnetic roller 40 and a non-magnetic sleeve 41. In this means, in the first rotation of the drum toner from the magnetic brush 42 is electrostatically attracted onto the photosensitive surface 29 to form an visual image thereon, in the second rotation of the drum, to toner on the photosensitive surface 29 is sucked by the magnetic brush, thereby performing cleaning function.

Between the exposure means and the copy paper cassette in the machine body 10 is disposed a mechanism for supplying the sheet of copy paper one by one and transporting the supplied paper, which includes a copy supplying mechanism 43 and a copy paper transporting mechanism 44. The supplying mechanism 43 includes a paper supplying cassette 19, a copy paper aligning means 45 and a paper supplying roller 46. The transporting mechanism 44 is an endless chain 47, and includes four sprocket wheels 48*a*, 48*b*, 48*c* and 48*d* in mesh with the chain 47, a roller 49, and a gripper 50 for catching the copy paper P coming from the copy paper cassette thereby transporting the copy paper. The transporting mechanism 44 further includes a copy paper charge remover 51 and a fixing means 53 with infrared lamps 52. The paper supplying roll 46 supplies the copy paper one by one from the paper supplying cassette 19, interlocking with the drive sprocket wheel 48*a* in mesh with the endless chain 47. Above-mentioned changing-transfer means 30 is disposed between the drive sprockets 48*b* and 48*c* provided above the endless chain 47. A drive means 54 is provided to drive the photosensitive drum 28 and its associated components, and the mechanism. The drive means 54 is disposed at the right lower side in the machine body 10.

It is to be noted, further, that on the left wall 10*b* are provided an outlet 55 permitting the copied paper, i.e. the copy paper electrophotographically processed, to egress therethrough and an opening 56 into which the paper supplying cassette 19 is inserted. These openings 55, 56 are provided on the same side as that to which the original holder 22 excessively moves. The paper receiving receptacle 18 is attached at the opening 55 so as to receive the sheets of copied paper therein. The paper supplying cassette 19 is inserted into the opening 56 with the extension or projection of one end thereof from the left side wall 10b. However, the extension of the cassette 19 is not necessarily needed. The necessity is that the paper feed cassette must be provided at the side of the electrophotographic copying machine at which the opening for the paper receiving opening is formed, i.e. that toward which the original holder 22 excessively moves in photocopying operation.

The explanation to follow is the operation of the electrophotographic copying machine thus constructed.

The power switch 11 is first turned on. By turning on the power switch 11, the infrared lamp 52 of the fixing means 53 lights up. When the infrared lamp 52 is heated to be a predetermined temperature, the thermostat (not shown) acts and at the same time the cooling fan (not shown) is driven. At this time, the ready lamp 15 lights up to indicated that the electrophotographic copying machine is ready for its photocopying operation. Then, the print button 12 is depressed. Upon the depression of the button, the drive means 54 is driven and then the rotary drum 28, the non-magnetic sleeve 41 fitted around the magnetic roller 40 of the development-cleaning means 34 and the chain 45 constituting the transporting mechanism 44 are driven. At this time, the charging-transfer means 30 discharges to spread positive charges over the photosensitive surface 29, the original holder 22 moves along the guide rails 20 to stop at the position as shown by the alternate long and two short dashes line in FIG. 3 and the lamp of the exposure means 31 lights. The result is that the original A becomes operable. The lamp 35 emits a ray of lights to illuminate the photosensitive surface 29 through the reflection of the mirror 36 and mirror lens 37. As a result, the reversed electrostatic latent image is formed on the photosensitive surface 29. At the completion of the scanning of original A, the original holder is brought back to the home position. The photosensitive surface bearing the latent image passes the corona charge remover 33 shielded by the corona shielding means 38 and touches the magnetic brush of developing agents formed by the magnetic roller 40 biased by a low voltage (50 to 200 V). At this place of the developing-cleaning means 34, the toner of the magnetic brush is electrostatically attracted on the photosensitive surface 29 to form an visual image thereon.

On the other hand, the paper supplying roller 46 disposed above the paper supplying cassette 19 descends to touch the uppermost paper of the copy paper P and its rotation feeds out the uppermost one from the cassette 19. The leading edge of the copy paper fed out is aligned by means of the aligning means 45 and then moves to reach the constanting position of the copy paper transporting mechanism 44. At this time, the gripper 50 closes and grips the leading edge of the copy paper P. Then, at the second rotation of the rotary drum revolutions, the copy paper is fed between the photosensitive rotary drum 29 and the charging-transfer means 30, where the reversed visual image formed on the photosensitive surface is transferred onto the copy paper to form a normal image thereon. Following this, the copy paper bearing the normal image thereon progresses ahead through the paper charge remover 51 for removing the charges on the copy paper and the fixing means 53 for fixing the normal image. The copy paper thus electrophotographically processed passes the roller 49 and emanates from the outlet 55 into the receptacle 18.

After the reversed visual image on the photosensitive surface 29 is transferred on the copy paper, the rotary drum 28 rotates to place such a surface underneath the residual image eraser 31 where it is subjected to the illumination by the lamp and then to move under the charge remover 33. At this time, the corona shielding means 38 of the charge remover 33 is dislocated to enable the corona charge remover 33 to positively charge the photosensitive surface 29. Through the illumination and charging operations, the charges remaining on the photosensitive surface 29 are removed. With further progression, the photosensitive surface 29 contacts the magnetic brush 42 of the magnetic roller 40 biased by the voltage from 200 to 800 V where most of the residual toner on the photosensitive surface is attracted by the magnetic brush.

In this manner, the rotary drum surface is cleaned and the rotary drum stops its rotation, while the original holder 22 returns to the home position for standing by for the next copying operation.

While the embodiment thus far described is the electrophotographic copying machine of the type where the copy paper is automatically fed from the copy paper cassette, the present invention is not limited to such an embodiment but applicable to the type where the copy paper is manually fed, and the type of two rotations-one copy, this invention may be of the type in which an image is directly formed on the copy paper without using a photosensitive member. Further, the copy paper cassette may be either of roll type or of sheet type.

The upshot is that the paper cassette or the manual paper feed guide and the receptacle for receiving the copy paper are provided at the side beyond which the original holder extends in photocopying operation.

As compared with the conventional electrophotographic copying machine in which the copy paper receiving receptacle and the copy paper cassette are provided at both sides of the electrophotographic copying machine, with projections therefrom and with the original holder reciprocable on the top wall, small is the area occupied by the electrophotographic copying machine in practical used. Further, the electrophotographic copying machine of the present invention may be placed contacting its side with so associated components with the corner of the room so that a limited space is effectively used for the electrophotographic copying machine installation. Moreover, in photocopying operation, the supply and receiving operations of the copy and copied paper may be carried out at one side of the machine body.

What is claimed is:

1. An electrophotographic copying machine comprising:
- a machine body including first and second sides opposite to each other;
- means for forming an image on a copy paper, including a photosensitive rotary drum disposed in the machine body;
- an original holder reciprocating on the body to extend over the first side;
- copy paper supplying means provided on the first side;
- a receptacle for receiving the copied paper, provided on the first side and extending outward therefrom;
- a mechanism for transporting the copy paper from the copy paper supplying means to the receptacle; and
- said means for forming an image further including an optical system, said optical system disposed between said first side and said rotary drum and above said mechanism.

2. An electrophotographic copying machine according to claim 1, wherein the copy paper transporting mechanism extends between the copy paper supplying means and the copied paper receptacle, both provided on the first side of the machine body, and passes beneath the rotary drum housed in the central portion of the machine body.

3. An electrophotographic copying machine according to claim 1, wherein said original holder reciprocates on said body to extend over only said first side and not said second side.

4. An electrophotographic copying machine according to claim 1, wherein said copy paper supplying means includes an opening formed in said first side of the machine body through which said copy paper is fed.

5. An electrophotographic copying machine according to claim 4, wherein said copy paper supplying means includes a cassette of copy paper sheets inserted in said opening formed in said first side with the end extended therefrom.

6. An electrophotographic copying machine according to claim 1, wherein said mechanism includes a chain for transporting said supplied copy paper;
- a gripper for catching the copy paper coming from said copy paper cassette;
- sprocket wheels for driving the chain; and
- a roller for driving cooperatively with the one sprocket wheel to supply the sheet from said cassette one by one.

7. An electrophotographic copying machine according to claim 4, wherein said receptacle is disposed above said opening.

* * * * *